United States Patent [19]

Osano et al.

[11] 4,352,346

[45] Oct. 5, 1982

[54] ELECTRONIC CONTROL SYSTEM FOR A CARBURETOR

[75] Inventors: Hisashi Osano, Koganei; Takuro Morozumi, Hachioji, both of Japan

[73] Assignees: Fuji Jukogyo Kabushiki Kaisha, Tokyo; Nissan Motor Co., Ltd., Yokohama, both of Japan

[21] Appl. No.: 134,612

[22] Filed: Mar. 27, 1980

[30] Foreign Application Priority Data

Mar. 28, 1979 [JP] Japan ..... 54-36411

[51] Int. Cl.[3] ..... F02M 1/08

[52] U.S. Cl. ..... 123/440; 123/179 G; 261/39 E

[58] Field of Search ..... 123/438, 440, 489, 491, 123/179 G, 589, 588; 261/39 E

[56] References Cited

U.S. PATENT DOCUMENTS

| | | | |
|---|---|---|---|
| 3,763,837 | 10/1973 | Orlando | 261/39 E |
| 3,780,718 | 12/1973 | Nambu et al. | 123/179 G |
| 3,949,551 | 4/1976 | Eichler et al. | 123/489 |
| 4,003,350 | 1/1977 | Eisele et al. | 123/489 |
| 4,050,424 | 9/1977 | Nelson | 261/39 E |
| 4,057,042 | 11/1977 | Aono | 123/440 |
| 4,109,615 | 8/1978 | Asano | 123/440 |
| 4,216,175 | 8/1980 | Schauer | 123/179 G |

FOREIGN PATENT DOCUMENTS 464760 4/1937 United Kingdom .

*Primary Examiner*—Charles J. Myhre
*Assistant Examiner*—Andrew M. Dolinar
*Attorney, Agent, or Firm*—Martin A. Farber

[57] ABSTRACT

An electronic control system for a carburetor of an internal combustion engine for controlling the air-fuel ratio to a value providing satisfactory cold engine operating performance. The system comprises an automatic choke device having a heater operative in response to the temperature of the device to close the choke valve, an oxygen sensor for detecting the content of the exhaust gases, an air-fuel ratio controlling means, and an electronic control means selectively operative to the signals from the oxygen sensor and the automatic choke device. The heater of the automatic choke device is a PTC heater, the resistance of which increases with the increase of the temperature thereof. The air-fuel ratio control means comprises an electromagnetic valve for controlling the fuel supply or air flow rate. When the oxygen sensor does not operate in the cold, the electronic control means is operated in accordance with the signal from the automatic choke device to actuate the air-fuel ratio control means for correcting the air-fuel ratio provided by the automatic choke device according to the current flowing through the heater to a value providing satisfactory operating performance.

7 Claims, 1 Drawing Figure

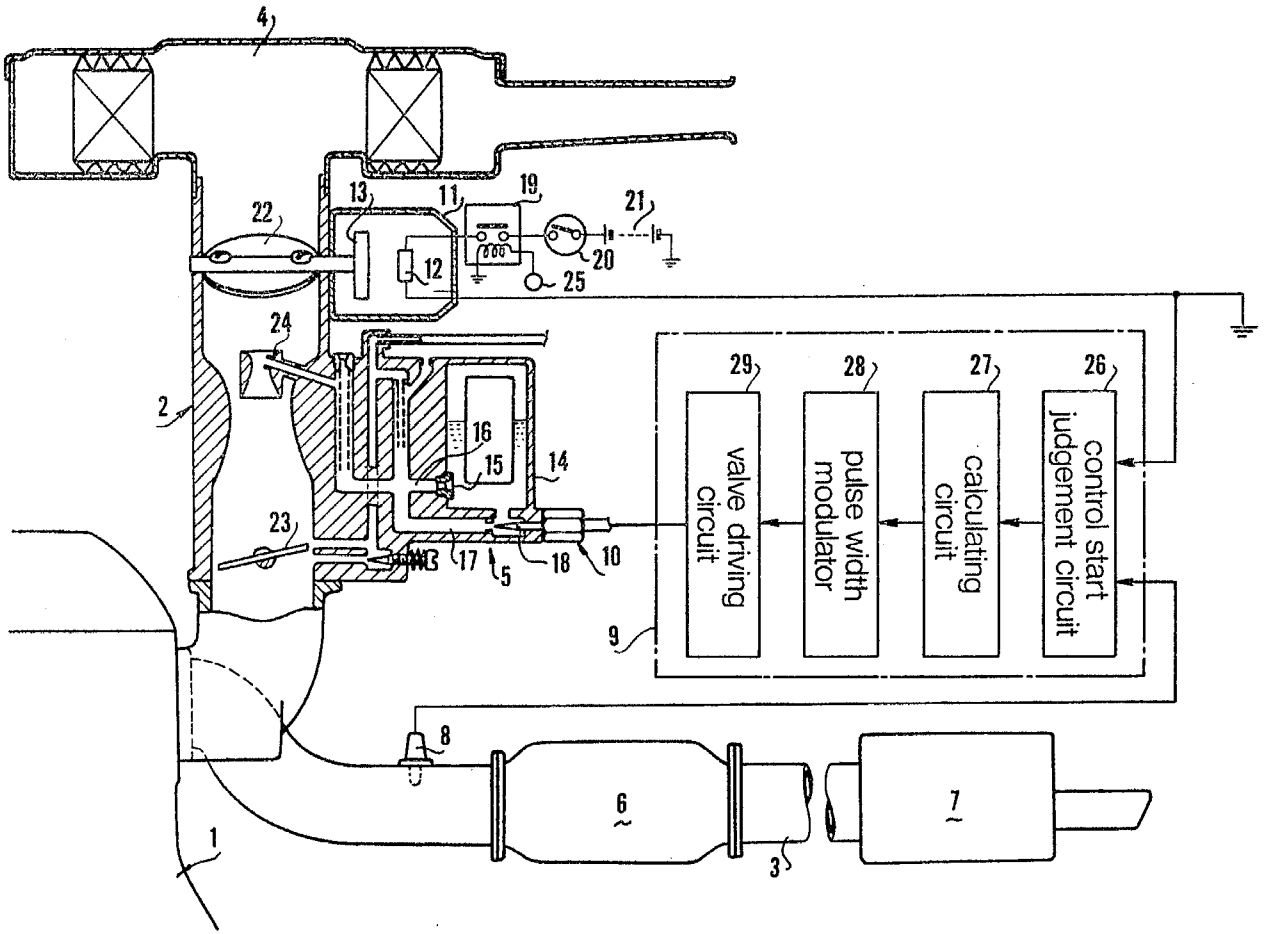
control start judgement circuit
calculating circuit
pulse width modulator
valve driving circuit
26
27
28
29
9
10
18
14
5
17
15
16
8
7
3
6
1
2
4
22
24
23
13
11
12
19
20
21
25

ELECTRONIC CONTROL SYSTEM FOR A CARBURETOR

BACKGROUND OF THE INVENTION

The present invention relates to an electronic control system for a carburetor of an internal combustion engine and more particularly to a means for controlling the air-fuel ratio of a mixture to a proper value during the warm-up operation of the engine.

Closed loop control systems for controlling the air-fuel ratio are known in the internal combustion engine emission control system art with the three-way catalyst. In one of such systems, the oxygen sensor for sensing the oxygen content of the exhaust gases and an electronic control means are provided for controlling an on-off electro-magnetic valve according to the signal from the oxygen sensor to provide the stoichiometric air-fuel ratio. The output voltage of the oxygen sensor varies according to the temperature of the sensor device. More particularly, when the temperature is below 300° C., the output voltage is too low to operate the electronic control means for controlling the air-fuel ratio.

In a conventional system, the duty ratio (the ratio of the duration of valve open period to one on-off cycle of the on-off electro-magnetic valve) is fixed to a predetermined ratio during cold engine operation for providing a lean air-fuel mixture, and, on the other hand, an automatic choke device is provided to correct the lean air-fuel mixture to a proper air-fuel ratio according to the engine temperature for improving the operability of the cold engine.

The automatic choke device is adapted to close the choke valve by a bimetal element according to the engine temperature so as to start the engine in the cold and to progressively open accordingly as the temperature rises. In the auto-choke device, a slight variation in flow area of the choke valve causes a great variation of the air-fuel ratio. Therefore, it is difficult to control the air-fuel ratio to a desirable value by the automatic choke device.

SUMMARY OF THE INVENTION

The object of the present invention is to provide an electronic control system for a carburetor which may correct the air-fuel ratio during the cold engine operation to a value providing satisfactory cold engine performance.

According to the present invention there is provided an electronic control system for a carburetor of an internal combustion engine having an induction passage means and an air-fuel mixture supply means, comprising a choke valve disposed in said induction passage means, a bimetal means for actuating said choke valve, a heater for heating said bimetal means, control means for controlling the air-fuel ratio of the mixture supplied by said air-fuel mixture supply means, and electronic control means for controlling said air-fuel ratio control means, said electronic control means being responsive to the output signal from said heater, whereby the air-fuel ratio can be controlled to a value providing satisfactory cold engine operation performance.

The present invention will be described by way of example with reference to the accompanying drawings.

BRIEF DESCRIPTION OF THE DRAWING

The single FIGURE of the drawing is a schematic view of an air-fuel ratio control system according to the present invention.

DETAILED DESCRIPTION OF THE PREFERRED EMBODIMENT

Referring to the FIGURE, an internal combustion engine 1 is provided with an induction passage means 2, and an exhaust passage means 2. An air cleaner 4 and a carburetor 5 are provided in the induction passage means 2 and a three-way catalytic converter 6 and a muffler 7 are provided in the exhaust passage means 3. An oxygen sensor 8 is provided on the exhaust pipe upstream of the three-way catalytic converter 6 for detecting the oxygen content of the exhaust gases. The output signal of the oxygen sensor 8 is applied to an electronic control means 9 for controlling an on-off electro-magnetic valve 10. An automatic choke device 11 comprises a positive temperature coefficient (PTC) heater 12 and a bimetal means 13 heated by the heater 12. The system is so arranged that the electric current flowing through the PTC heater 12 is applied to the electronic control means 9 as a voltage signal. The electronic control means 9 is so arranged as to produce an on-off signal according to the signal from the PTC heater 12 for controlling the on-off electro-magnetic valve 10 during the cold engine operation for fuel supply.

The carburetor 5 comprises a float chamber 14, a main fuel jet 15, a main fuel passage 16 and a bypass fuel passage 17. The bypass fuel passage 17 is intermittently closed and opened by the plunger 18 of the on-off electro-magnetic valve 10. The PTC heater 12 is connected to a battery 21 through a relay 19 and a key switch 20. Resistance of the PTC heater 12 is low in the cold and increases with increasing temperature. Thus, in the cold, the choke valve 22 is closed and progressively opened by the operation of the bimetal means 13 accordingly as the temperature increases.

In the FIGURE, a throttle valve 23, a main nozzle 24 of the carburetor 5, and an alternator 25 are illustrated. The electronic control means 9 comprises a control start judgement circuit 26, a calculating circuit 27, a pulse width modulator 28, and a valve driving circuit 29.

In operation, when the key switch 20 is closed, the engine is started and the alternator 25 is operated. Thus, the relay 19 is operated to close the contact to operate the PTC heater 12. The control start judgement circuit 26 acts to judge the output signals from the oxygen sensor 8 and the PTC heater 12. When the voltage applied from the oxygen sensor 8 is less than a predetermined level, the judgement circuit 26 operates to cut off the signal from the oxygen sensor and to enable the signal from the PTC heater 12 to effect the operation of the electronic control means. Thus, the electronic control means 9 operates to produce the on-off signal according to the signal from the PTC heater 12 for operating the on-off electro-magnetic valve 10. In the cold engine operation, the resistance of the PTC heater is low and the voltage of the signal applied to the electronic control means from the PTC heater is high, so that the electronic control means 9 produces an on-off signal so as to provide a small duty ratio of the on-off valve 10. Thus, flow rate of the fuel is decreased thereby to provide a lean air-fuel mixture. Consequently, it is possible to correct the air-fuel ratio provided by the automatic choke device to prevent an excessively rich air-fuel ratio. Depending on the increase of the temperature of the PTC heater, the resistance of the heater increases, thereby decreasing the voltage applied to the electronic control means 9. As a result, the duty ratio is increased, so that a rich air-fuel mixture may be provided. Thus, the air-fuel ratio is controlled by the electronic control means 9 and the automatic choke device during the warm-up operation of the engine to a desirable air-fuel ratio. Therefore, the cold engine operation may be properly performed with a corrected air-fuel mixture. After the engine has been warmed up, when the voltage from the oxygen sensor 8 reaches the predetermined level, the judgement circuit 26 operates to cut off the signal from the PTC heater and to allow the operation by the signal from the oxygen sensor. Thus, the electronic control means 9 controls the duty ratio of the on-off valve 10 to provide the stoichiometric air-fuel ratio.

It will be understood that on-off electro magnetic valves may be provided in the air bleed passage and/or air bypass to control air-flow rate instead of controlling the fuel flow rate, and that exhaust gas component detecting means other than an oxygen sensor and actuators other than the on-off electro magnetic valve may be employed.

From the foregoing it will be observed that the present invention provides an electronic control system which may control the air-fuel ratio to a value providing satisfactory cold engine performance during the cold engine operation.

What is claimed is:

1. An electronic control system for a carburetor of an internal combustion engine having an induction passage means and an air-fuel mixture supply means, comprising:

a choke valve disposed in said induction passage means, bimetal means for actuating said choke valve, a heater for heating said bimetal means, detecting means for detecting the content of exhaust gases, control means for controlling the air-fuel ratio of the mixture supplied by said air-fuel mixture supply means, electronic control means for actuating said air-fuel ratio control means, said electronic control means for being responsive to current passing through said heater and to an output signal from said detecting means, respectively, such that the air-fuel ratio is controlled to a value providing satisfactory cold engine operating performance by said current passing through said heater, and is controlled to the stoichiometric air-fuel ratio by said output signal from said detecting means when the engine has been warmed-up, respectively.

2. An electronic control system according to claim 1 wherein said detecting means is an oxygen sensor.

3. An electronic control system according to claim 1 wherein said air-fuel ratio control means comprises an on-off electro magnetic valve and said electronic control means is adapted to produce on-off pulses for operating said air-fuel ratio control means.

4. An electronic control system according to claim 1 wherein said heater is a positive temperature coefficient heater.

5. The electronic control system according to claim 1 or 2, wherein:

said control means includes a control start judgement circuit means for cutting off said output signal from said detecting means when said output signal is below a predetermined level and for cutting off a signal of said current when said output signal reaches another predetermined level.

6. An electronic control system according to claim 5 wherein said heater is a positive temperature coefficient heater.

7. An electronic control system for a carburetor of an internal combustion engine having an induction passage means and an air-fuel mixture supply means, comprising:

a choke valve disposed in said induction passage means, bimetal means for actuating said choke valve, an automatically controllable heater for heating said bimetal means, control means for controlling the air-fuel ratio of the mixture supplied by said air-fuel mixture supply means, electronic control means for actuating said air-fuel ratio control means, said electronic control means for being responsive to current passing through said heater for controlling the air-fuel ratio to a value providing satisfactory cold engine operating performance by said current passing through said heater, said air-fuel ratio control means comprises an on-off electromagnetic valve and said electronic control means is adapted to produce on-off pulses for operating said air-fuel ratio control means.

* * * * *